US007104901B1

(12) United States Patent
Mason

(10) Patent No.: US 7,104,901 B1
(45) Date of Patent: Sep. 12, 2006

(54) HOCKEY TRAINING SYSTEM

(76) Inventor: Donald Mason, 18391 Gladstone Blvd., Maple Grove, MN (US) 55311

( * ) Notice: Subject to any disclaimer, the term of this patent is extended or adjusted under 35 U.S.C. 154(b) by 44 days.

(21) Appl. No.: 10/822,088

(22) Filed: Apr. 8, 2004

(51) Int. Cl.
*A63B 69/00* (2006.01)
*A63B 63/00* (2006.01)
*A63B 71/00* (2006.01)

(52) U.S. Cl. ..... 473/446; 473/478; 482/51

(58) Field of Classification Search ..... 473/446, 473/422, 452, 471, 470, 476, 478, 218; 482/51, 482/27, 28
See application file for complete search history.

(56) References Cited

U.S. PATENT DOCUMENTS 3,512,774 A * 5/1970 Honer ..... 482/147
3,955,815 A * 5/1976 Deschesnes ..... 473/446
D255,372 S * 6/1980 Tidmore ..... D21/688
4,483,531 A * 11/1984 Laseman et al. ..... 482/27
4,497,483 A 2/1985 Ahlgren
4,607,842 A 8/1986 Daoust
4,824,100 A * 4/1989 Hall et al. ..... 482/28
5,161,799 A * 11/1992 Nandra ..... 473/446
5,322,490 A * 6/1994 Van Der Hoeven ..... 482/51
5,425,691 A * 6/1995 Van Der Hoeven ..... 482/51
5,470,292 A * 11/1995 Simon ..... 482/52
5,509,652 A 4/1996 Woronets
5,593,370 A * 1/1997 Meldeau ..... 482/51
5,771,706 A 6/1998 Lavigne
5,820,470 A 10/1998 Saunders
D401,646 S * 11/1998 Seelye ..... D21/671
5,897,438 A 4/1999 Kunz et al.
5,906,545 A 5/1999 Eden et al.
6,059,673 A * 5/2000 Mason ..... 473/478
6,099,420 A * 8/2000 Nandra ..... 473/446
6,162,061 A * 12/2000 Taylor ..... 434/253
6,569,041 B1 * 5/2003 Riivald ..... 473/446
D481,086 S * 10/2003 Broudy ..... D21/689
6,846,252 B1 * 1/2005 Nudo ..... 473/446
2004/0002411 A1 * 1/2004 Jackson ..... 482/121

* cited by examiner

*Primary Examiner*—Mitra Aryanpour

(57) ABSTRACT

A hockey training system for providing a versatile hockey training apparatus capable of providing various hockey training techniques. The hockey training system includes a base having an outer perimeter, a pair of platforms positionable upon the base, a pair of cover members positionable upon the upper portion of the base, a pair of reserve units designed to retain a plurality of pucks and a shooting member for allowing the user to shoot pucks upon. The hockey training system is positionable within a plyometrics position, a stepping box position, a shooting position and a sliding position for providing versatile training for a hockey player within a single unit.

14 Claims, 11 Drawing Sheets

HOCKEY TRAINING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to hockey training devices and more specifically it relates to a hockey training system for providing a versatile hockey training apparatus capable of providing various hockey training techniques.

2. Description of the Related Art

Plyometric training devices and slide boards have individually been in use for years. However, none of these devices are designed for hockey training. In addition, none of these devices have been combined to form a single structure capable of providing the same along with a hockey shot practice system.

While these devices may be suitable for the particular purpose to which they address, they are not as suitable for providing a versatile hockey training apparatus capable of providing various hockey training techniques. Conventional training devices are not as suitable for providing a versatile hockey training system.

In these respects, the hockey training system according to the present invention substantially departs from the conventional concepts and designs of the prior art, and in so doing provides an apparatus primarily developed for the purpose of providing a versatile hockey training apparatus capable of providing various hockey training techniques.

BRIEF SUMMARY OF THE INVENTION

In view of the foregoing disadvantages inherent in the known types of hockey training systems now present in the prior art, the present invention provides a new hockey training system construction wherein the same can be utilized for providing a versatile hockey training apparatus capable of providing various hockey training techniques.

The general purpose of the present invention, which will be described subsequently in greater detail, is to provide a new hockey training system that has many of the advantages of the hockey training systems mentioned heretofore and many novel features that result in a new hockey training system which is not anticipated, rendered obvious, suggested, or even implied by any of the prior art hockey training systems, either alone or in any combination thereof.

To attain this, the present invention generally comprises a base having an outer perimeter, a pair of platforms positionable upon the base, a pair of cover members positionable upon the upper portion of the base, a pair of reserve units designed to retain a plurality of pucks and a shooting member for allowing the user to shoot pucks upon. The hockey training system is positionable within a plyometrics position, a stepping box position, a shooting position and a sliding position for providing versatile training for a hockey player within a single unit.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a hockey training system that will overcome the shortcomings of the prior art devices.

A second object is to provide a hockey training system for providing a versatile hockey training apparatus capable of providing various hockey training techniques.

Another object is to provide a hockey training system that is capable of having various positions such as a plyometrics position, a stepping box position, a puck shooting position and a sliding position.

An additional object is to provide a hockey training system that may be easily stored and used.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
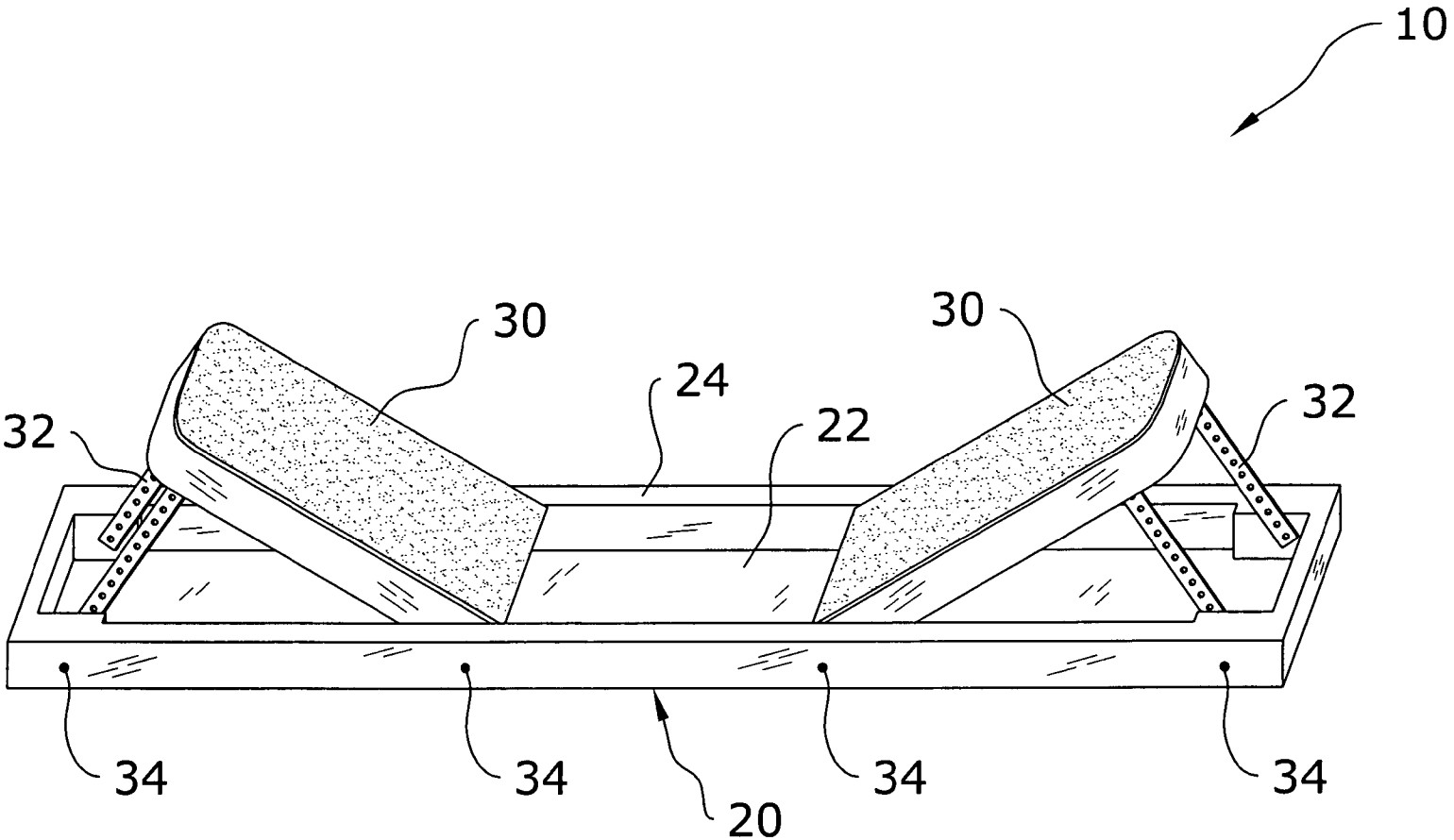
FIG. 1 is an upper perspective view of the present invention showing the platforms in the plyometric position.

Turning now descriptively to the drawings, in which similar reference characters denote similar elements throughout the several views, FIGS. 1 through 11 illustrate a hockey training system 10, which comprises a base 20 having an outer perimeter 24, a pair of platforms 30 positionable upon the base 20, a pair of cover members 40 positionable upon the upper portion of the base 20, a pair of reserve units 50 designed to retain a plurality of pucks 12 and a shooting member 60 for allowing the user to shoot pucks 12 upon. The hockey training system is positionable within a plyometrics position, a stepping box position, a shooting position and a sliding position for providing versatile training for a hockey player within a single unit.

B. Base

Figure 10:
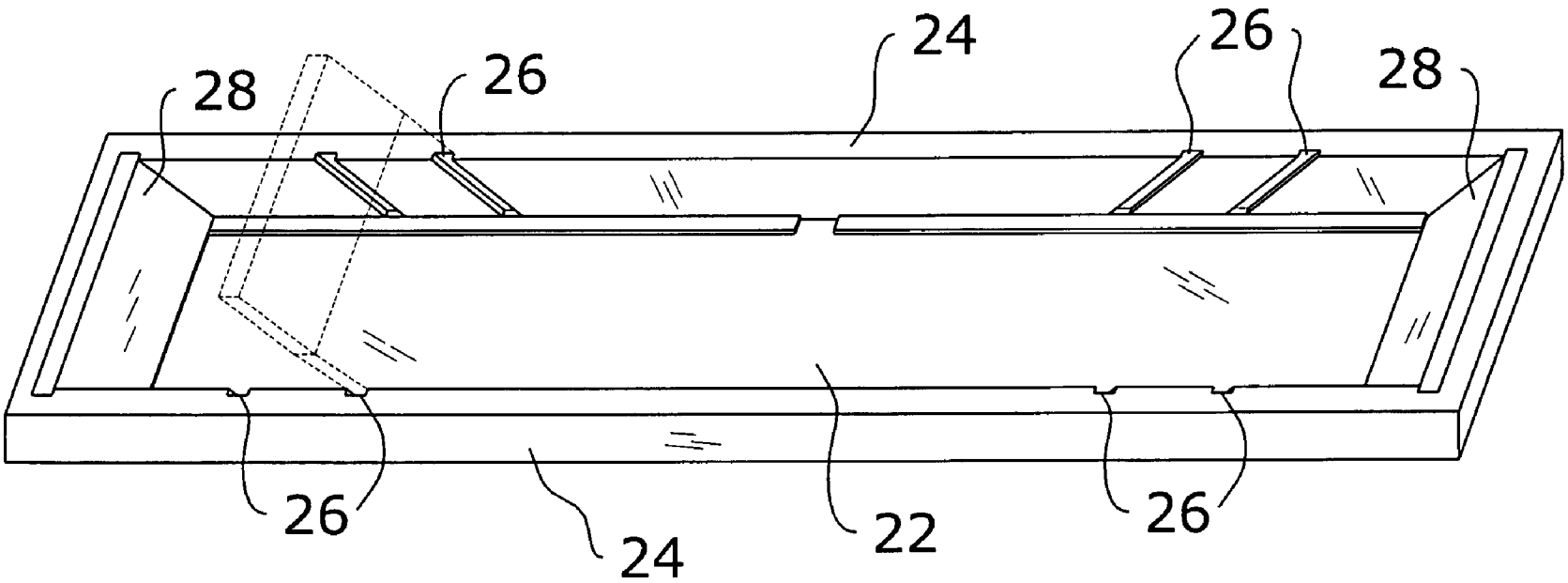
FIG. 10 is an upper perspective view of the present invention in the sliding position.
Figure 11:
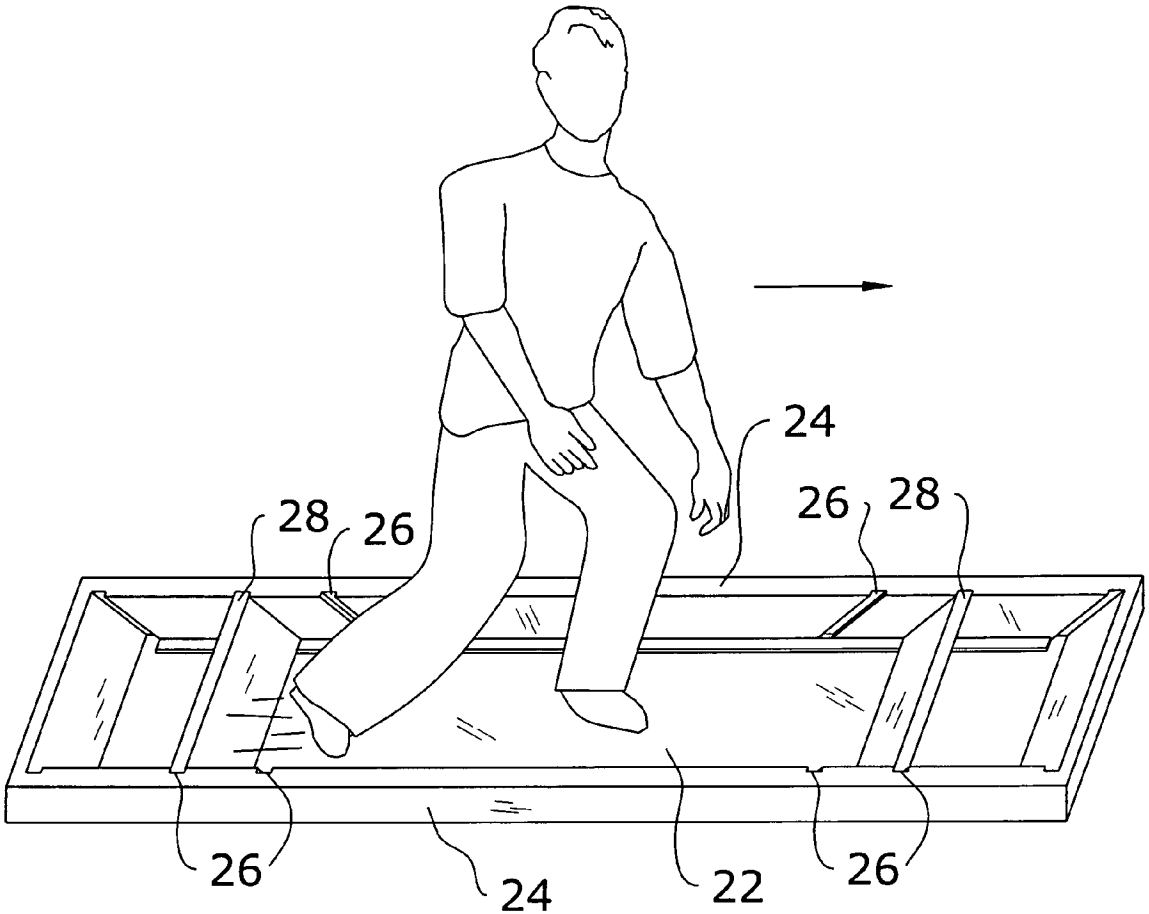
FIG. 11 is an upper perspective view of the present invention in the sliding position with an individual practicing upon the same.

The base 20 is comprised of a generally flat and elongated structure as best shown in FIGS. 10 and 11 of the drawings. The base 20 has a floor 22 having a slippery surface that is usable by a user as a slide board when the present invention is in the sliding position as shown in FIGS. 10 and 11 of the drawings. The base 20 may have various lengths and widths as desired to accommodate an individual in a sliding position.

The base 20 preferably includes an outer perimeter 24 defining the floor 22 as best shown in FIGS. 10 and 11 of the drawings. The floor 22 is preferably comprised of a slippery material such as but not limited to plastic. The base 20 preferably includes a pair of end members 28 at the interior end portions of the base 20, wherein the end members 28 are preferably angled for the user to engage when operating the base 20 in the sliding position. A plurality of angled slots 26 preferably extend within an interior portion of the outer perimeter 24 as shown in FIGS. 10 and 11 of the drawings. The pair of end members 28 are removably and adjustably positionable within the angled slots 26 for defining a sliding area upon the floor 22 for a user performing a sliding exercise. For example, the user may create a shorter sliding area by positioning the end members 28 closer together or a longer sliding area by positioning the end members 28 farther apart.

C. Platforms

Figure 3:
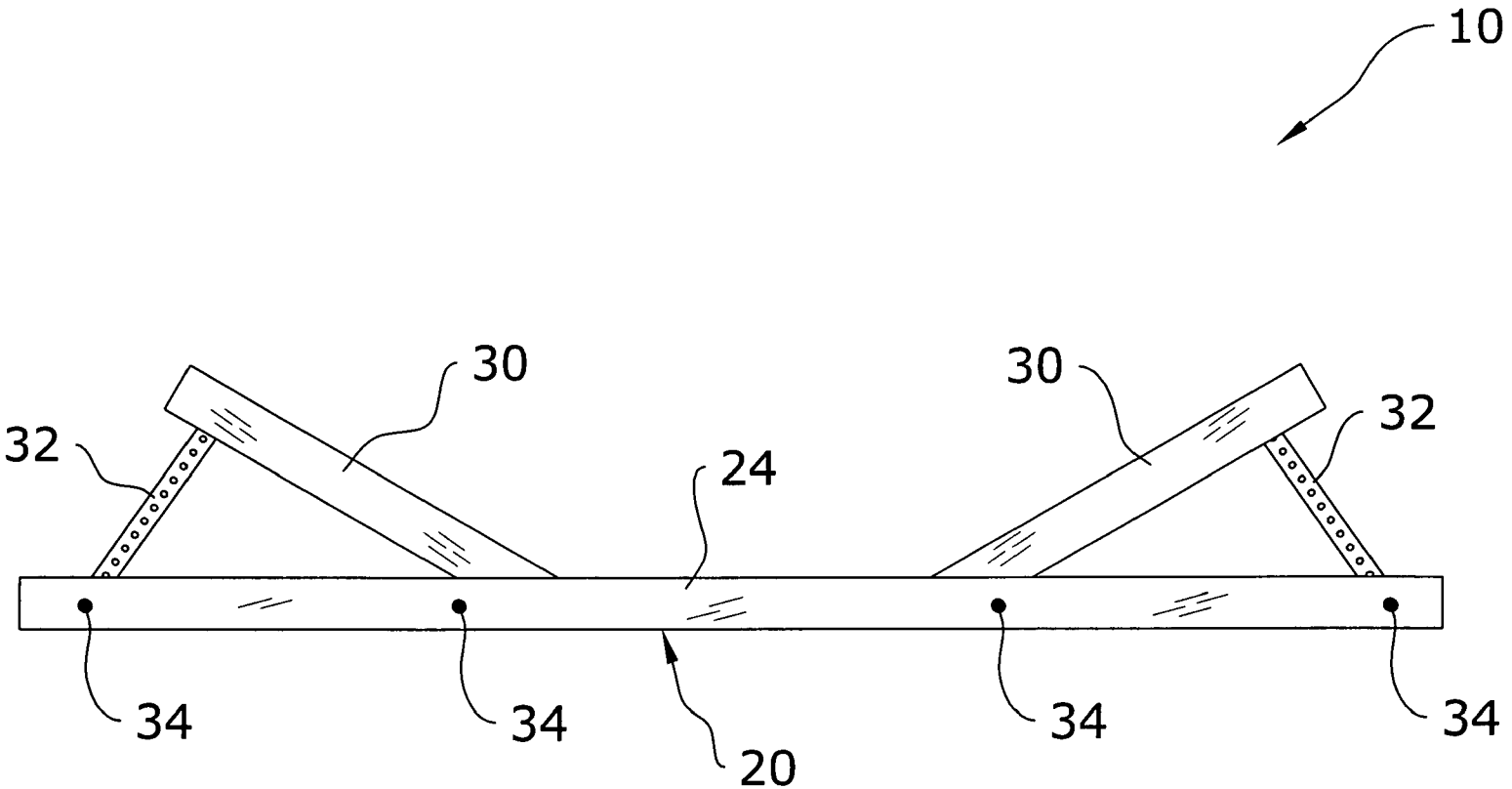
FIG. 3 is a front view of the present invention showing the platforms in the plyometrics position.
Figure 4:
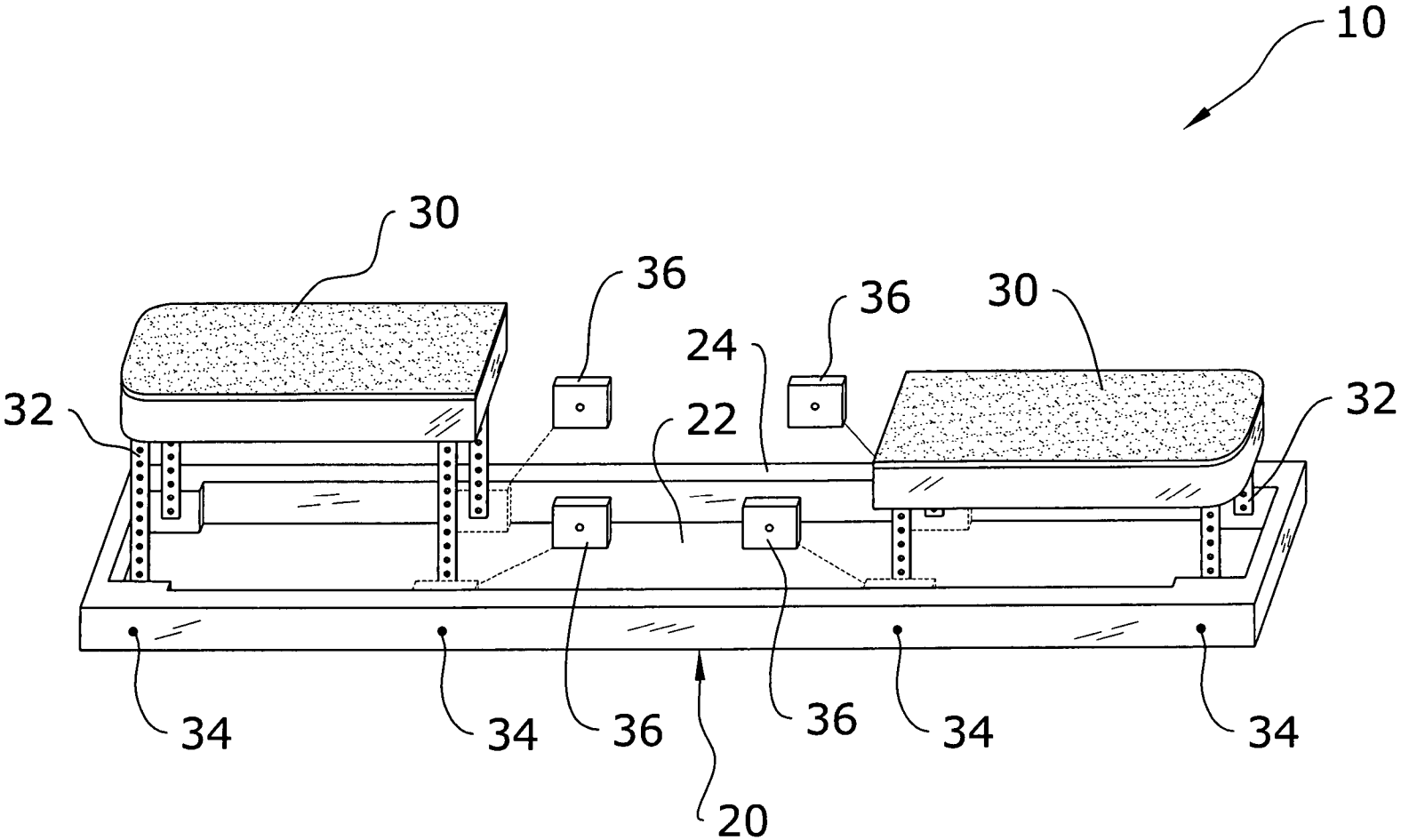
FIG. 4 is an upper perspective view of the present invention with the platforms in the stepping box position.
Figure 5:
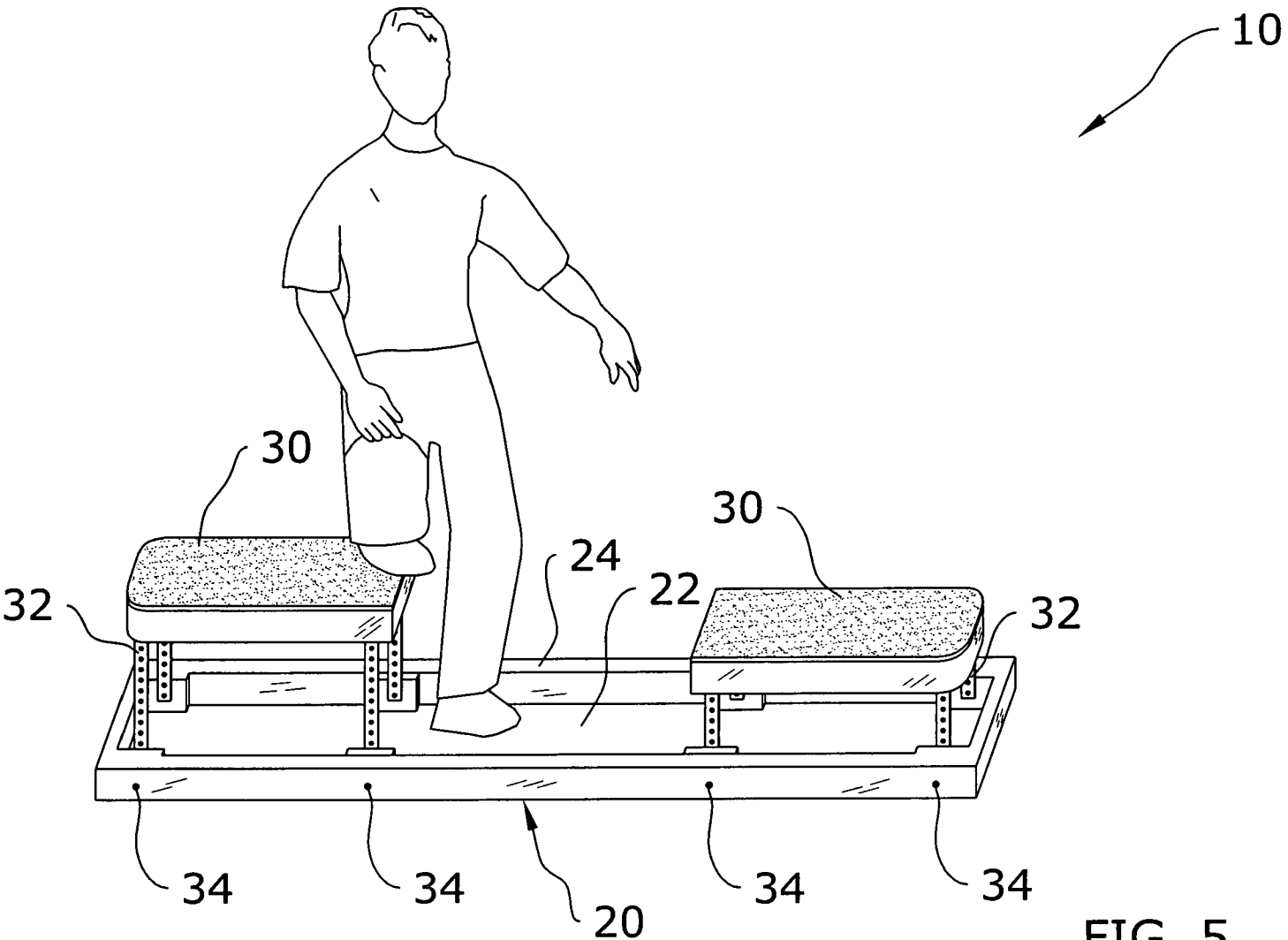
FIG. 5 is an upper perspective view of an individual stepping upon the platforms.
Figure 6:
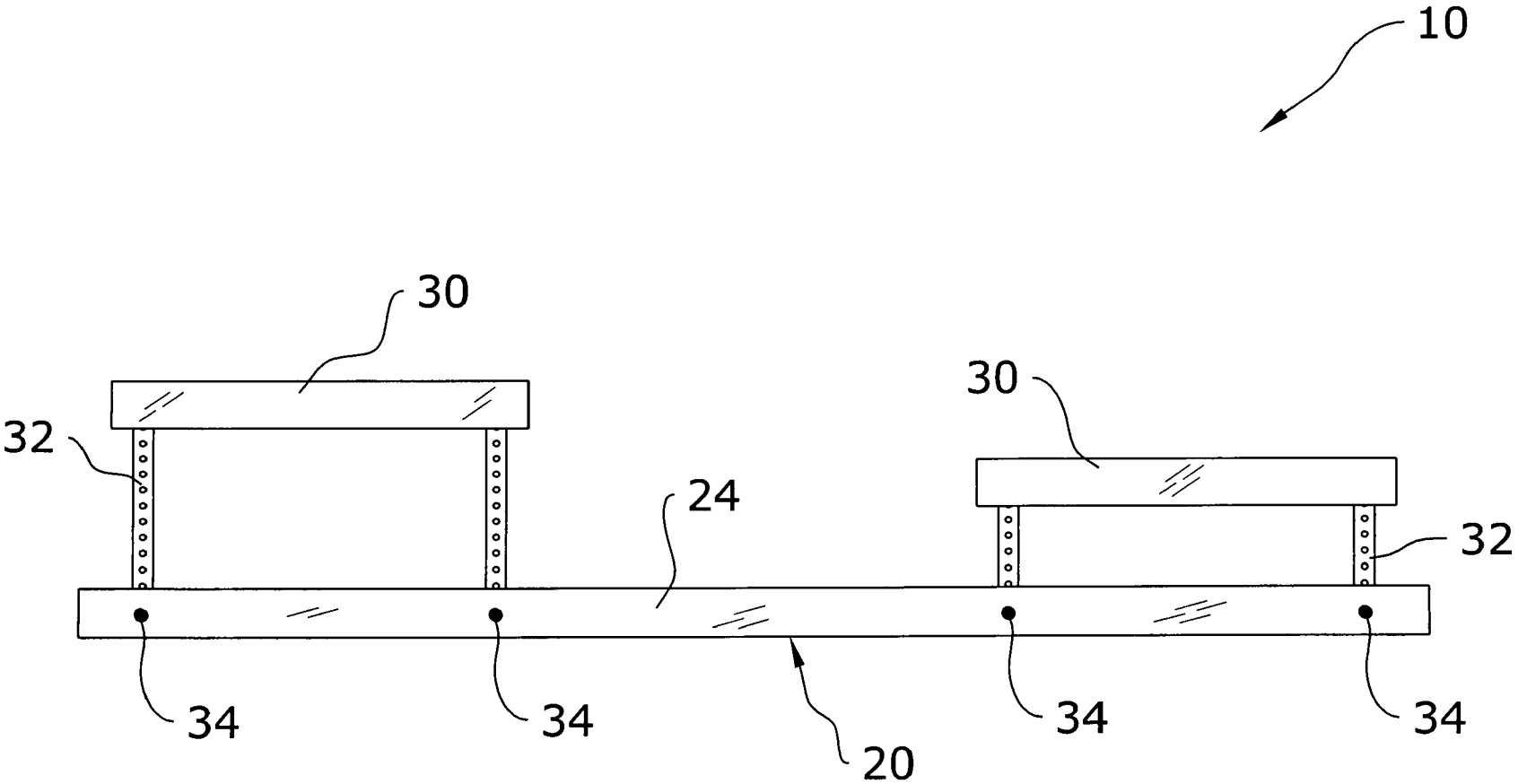
FIG. 6 is a front view of the present invention showing the platforms in the stepping box position.

The pair of platforms 30 are positionable upon the base 20 in either a plyometrics position (FIGS. 1 through 3) or a stepping box position (FIGS. 4 through 6). The platforms 30 have an upper member and at least a pair of outer legs 32. The pair of outer legs 32 support the pair of platforms 30 inwardly in a plyometrics position as further shown in FIGS. 1 through 3 of the drawings.

The pair of platforms 30 may also each include a pair of inner legs 32 to create a stepping box position as shown in FIGS. 4 through 6 of the drawings. The inner legs 32 and the outer legs 32 are preferably comprised of a similar length to create a substantially horizontal platform 30 as best illustrated in FIG. 6 of the drawings. The platforms 30 in the stepping box position may have various heights as can be appreciated by one skilled in the art. The legs 32 are attachable to the base 20 by a plurality of pins 34 extending through the base 20 and a lower end of the legs 32 as shown in FIGS. 1 through 6 of the drawings.

D. Cover Member

Figure 8:
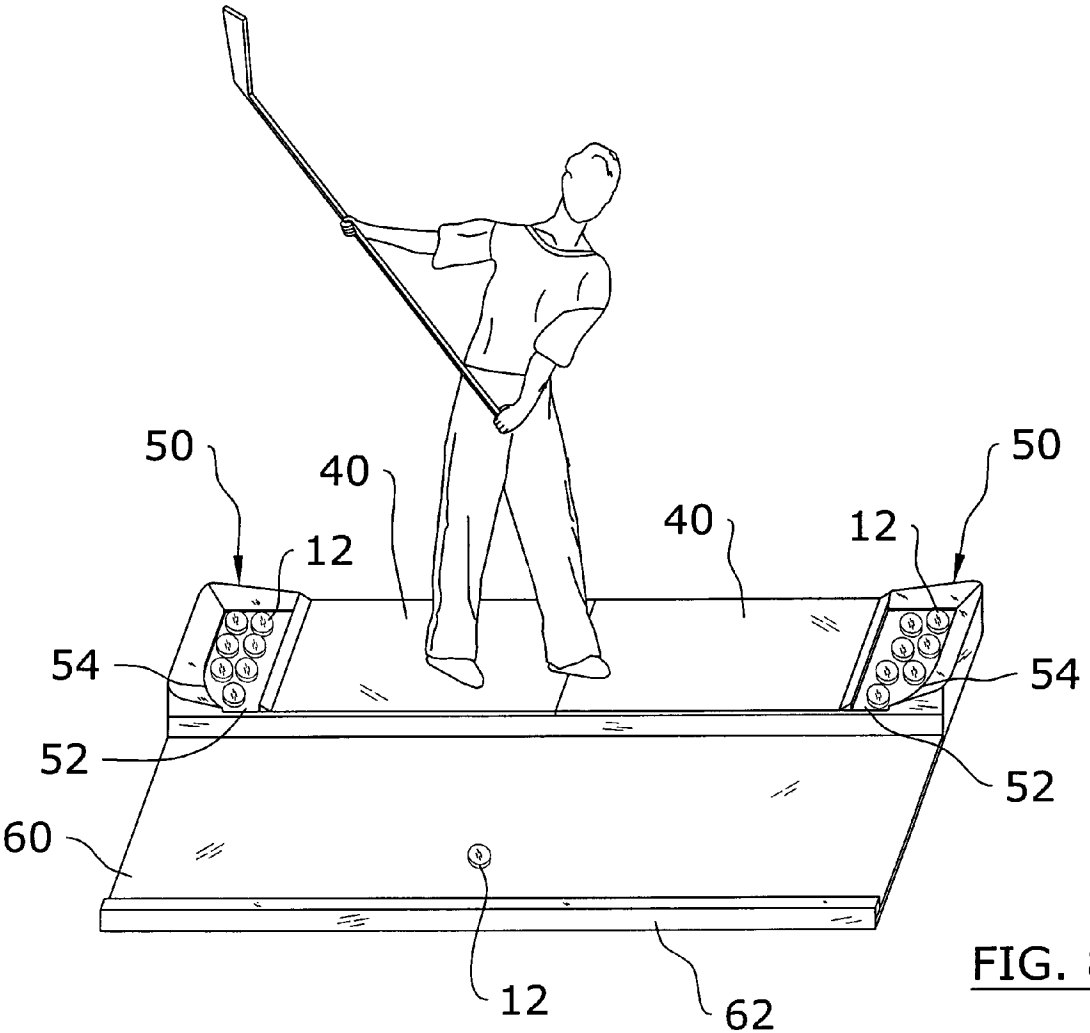
FIG. 8 is an upper perspective view of the present invention in the shooting position with an individual positioned upon the cover members.

At least one cover member is positionable upon an upper portion of the base 20 for a user to stand upon while practicing their shooting upon the shooting member 60. The cover member positioned upon the outer perimeter 24 of the base 20 provides an elevated position for the user thereby allowing them to stand upon without ice skates and provide a similar elevation above the surface of the shooting member 60 as if they were wearing ice skates as best shown in FIG. 8 of the drawings. The cover member may be comprised of any flat and rigid structure capable of supporting a user.

E. Shooting Member

Figure 7:
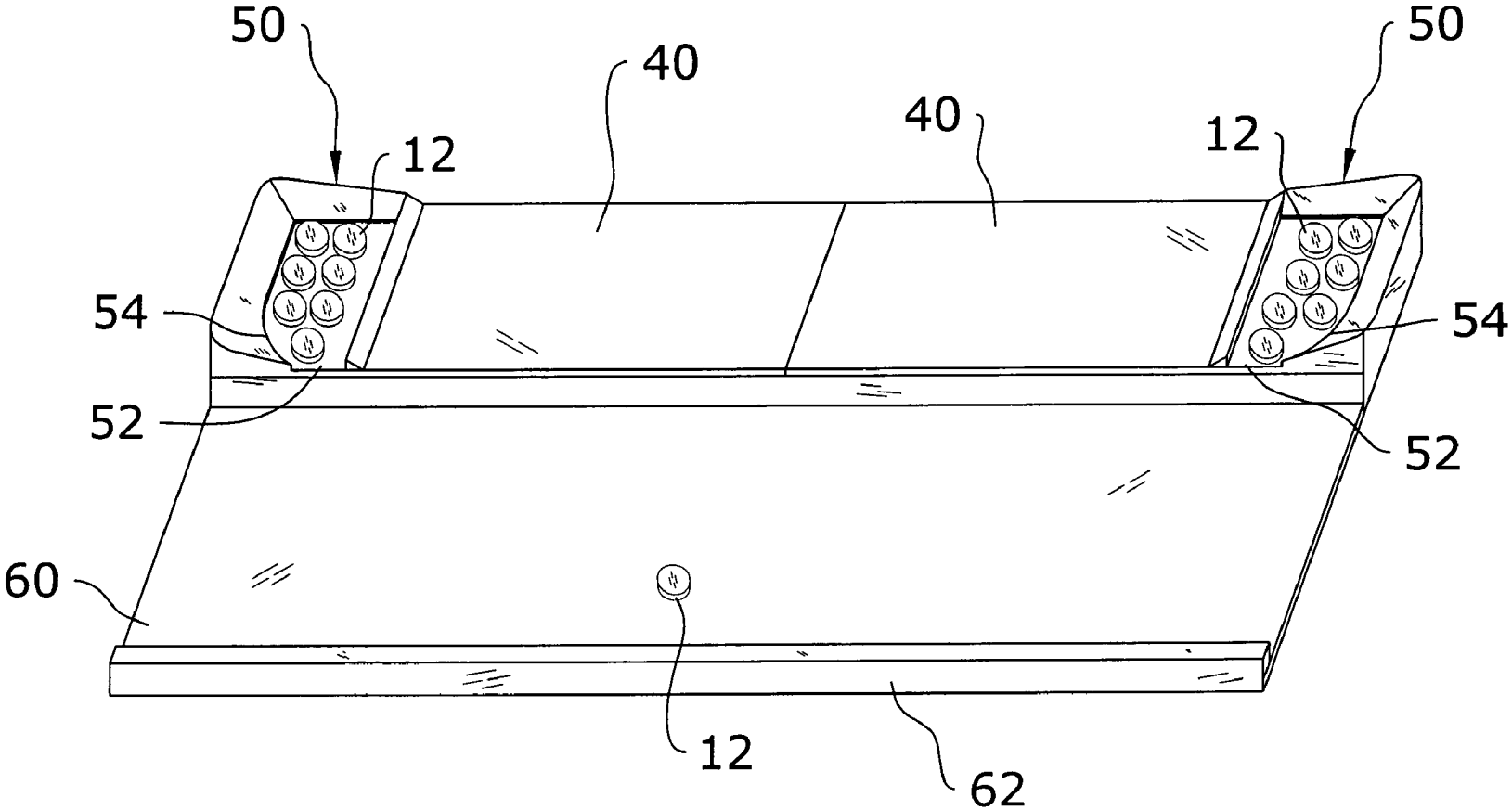
FIG. 7 is an upper perspective view of the present invention in the shooting position.
Figure 9:
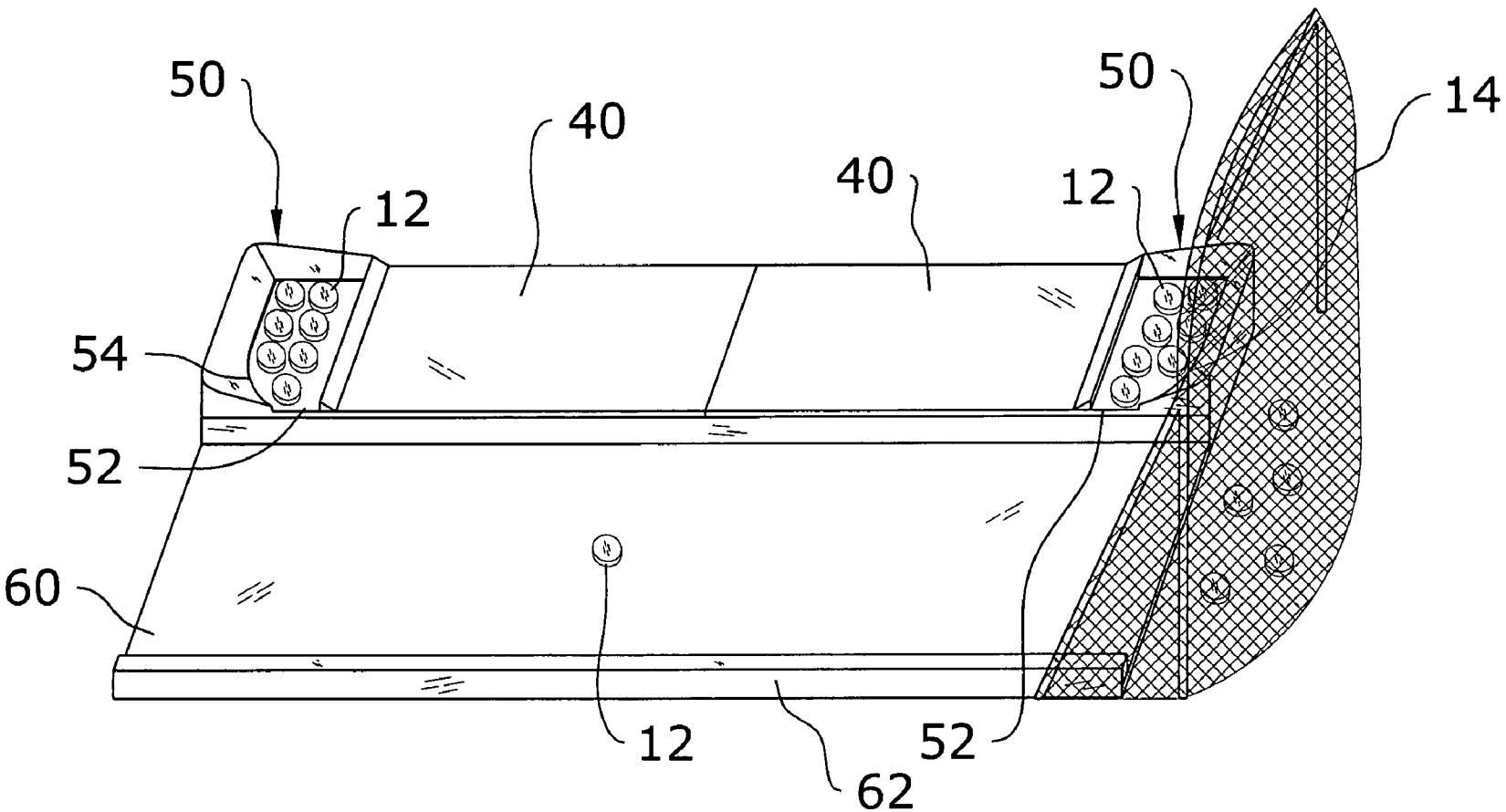
FIG. 9 is an upper perspective view of the present invention in the shooting position with a net.

The shooting member 60 preferably has an upper slippery surface for allowing a user to practice shooting hockey pucks 12 upon while standing upon the cover member as shown in FIGS. 7 through 9 of the drawings. The shooting member 60 preferably has an outer edge 62 for preventing the hockey pucks 12 from falling off the outer portion thereof.

The shooting member 60 is preferably comprised of a flat and elongate structure that is positionable adjacent to (or attached to) the base 20 as shown in FIGS. 7 through 9 of the drawings. The shooting member 60 is preferably positionable substantially parallel with respect to the base 20 as shown in FIGS. 7 through 9 of the drawings. At least one conventional hockey net 14 may be positioned at one of the opposing ends of the shooting member 60 for catching the hockey pucks 12 as they are shot by a user.

F. Reserve Unit

At least one reserve unit 50 is positionable upon an end of the base 20, wherein the reserve unit 50 is designed to retain and dispense a plurality of pucks 12 as shown in FIGS. 7 through 9 of the drawings. The reserve unit 50 preferably includes a side opening 52 for allowing a user to remove and dispense hockey pucks 12 from the at least one reserve unit 50. The reserve unit 50 also preferably includes a curved portion 54 connected to the side opening 52 for assisting in guiding hockey pucks 12 from the reserve unit 50. The at least one reserve unit 50 may be comprised of a pair of reserve units 50 positionable upon opposing ends of the base 20 as shown in FIGS. 7 through 9 of the drawings.

G. Operation of Invention In use, the user first determines if they want the invention within the plyometrics position (FIGS. 1 through 3), the stepping box position (FIGS. 4 through 6), the shooting position (FIGS. 7 through 9) or the sliding position (FIGS. 10 and 11).

Figure 2:
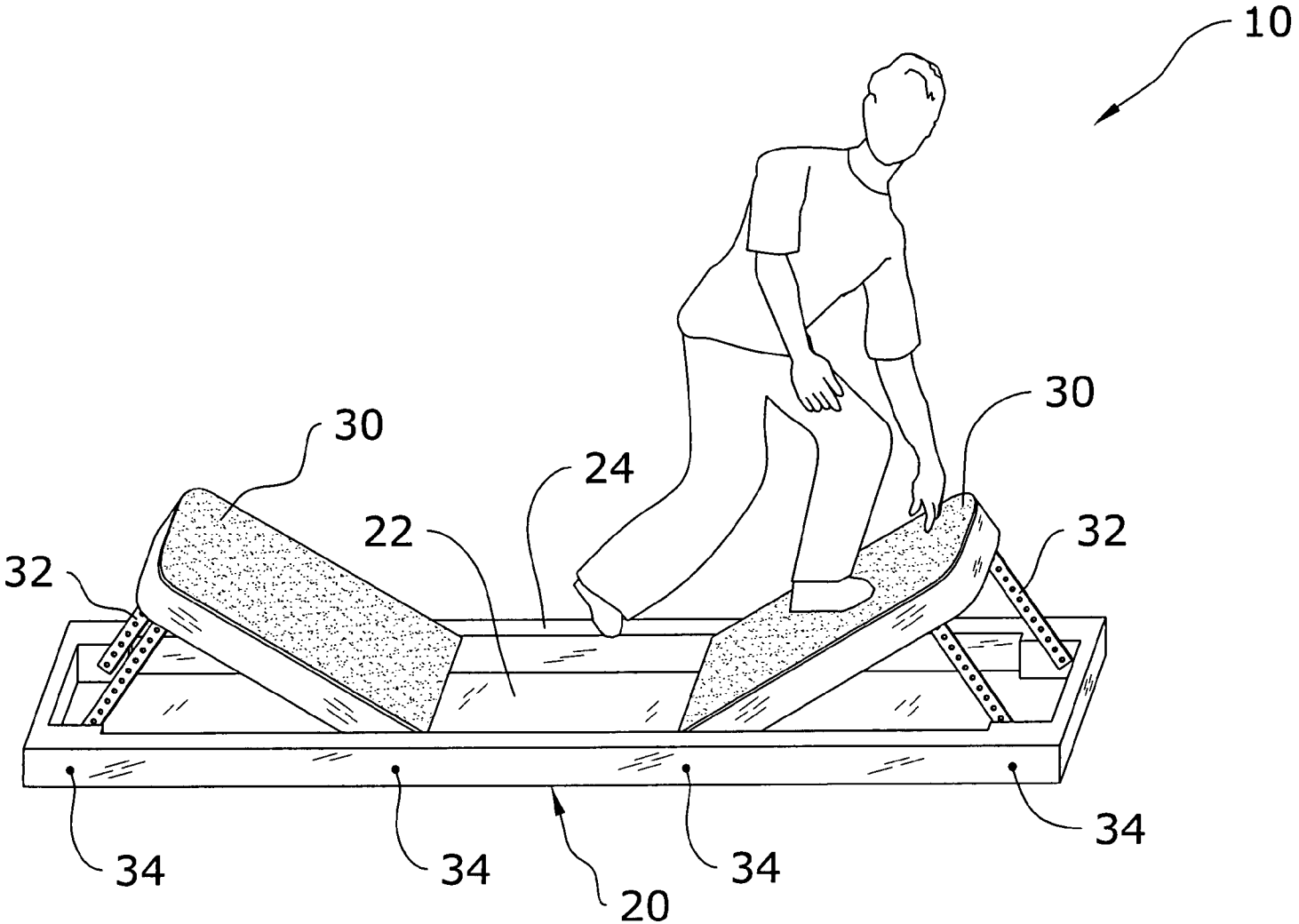
FIG. 2 is an upper perspective view showing an individual practicing plyometrics.

If the user desires to utilize the plyometrics position, the user simply utilizes the platforms 30 with the outer pair of legs 32 (without the inner pair of legs 32) thereby creating an inwardly slanting position for the platforms 30 as best illustrated in FIG. 4 of the drawings. The outer pair of legs 32 and the inner portion of the platforms 30 are preferably attached to the outer perimeter 24 of the base 20 by a plurality of pins 34 as shown in FIGS. 1 through 3 of the drawings. The user is then able to utilize the present invention as a plyometrics exercise device as shown in FIG. 2 of the drawings.

If the user desires to utilize the stepping box position, they attach the inner pair of legs 32 to create a substantially horizontal platform 30 as shown in FIGS. 4 through 6 of the drawings. A pair of spacers 36 may be positioned on the outside of the inner pair of legs 32 as shown in FIGS. 4 and 5 of the drawings. The legs 32 are then attached to the outer perimeter 24 of the base 20 by a plurality of pins 34 as shown in FIGS. 4 through 6 of the drawings. The user is then able to utilize the present invention as a stepping exercise device as shown in FIG. 5 of the drawings.

If the user desires to utilize the shooting position, they position the cover members 40 upon the outer perimeter 24 of the base 20 to stand upon as shown in FIGS. 7 through 9 of the drawings. The user also positions the shooting member 60 adjacent to the base 20 to shoot hockey pucks 12 upon. The user may also attach the reserve units 50 to the opposing ends of the base 20 as shown in FIGS. 7 through 9 of the drawings. The user may also position a hockey net 14 near an end of the shooting member 60 as shown in FIG. 9. The user is then able to utilize the present invention as a hockey puck shooting exercise device as shown in FIG. 8 of the drawings.

If the user desires to utilize the sliding position, they remove the platforms 30, the reserve units 50 and/or the cover members 40 to expose the floor 22 of the base 20 as shown in FIGS. 10 and 11 of the drawings. The user then positions the end members 28 in the desired slots 26 to create a desired length of sliding area. The user then is able to utilize the present invention as a sliding exercise device as shown in FIG. 10 of the drawings.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A hockey training system, comprising:

a base useable by a user as a slide board in a sliding position;

a pair of platforms positionable upon said base in either a plurality of angled plyometrics position or a stepping box position;

at least one cover member positionable upon an upper portion of said base for a user to stand upon;

a shooting member having an outer edge for allowing a user to practice shooting hockey pucks upon while standing upon said at least one cover member, wherein said shooting member has an upper slippery surface;

a net positionable at an end of said shooting member for arresting hockey pucks; and at least one reserve unit positionable upon an end of said base, wherein said at least one reserve unit is designed to retain and dispense a plurality of pucks, and wherein said at least one reserve unit includes a side opening for allowing a user to remove hockey pucks from said at least one reserve unit.

2. The hockey training system of claim 1, wherein said base includes a raised outer perimeter defining a floor comprised of a slippery plastic material.

3. The hockey training system of claim 1, wherein said pair of platforms each include a pair of adjustable outer legs thereby angling said pair of platforms inwardly in a plyometrics position.

4. The hockey training system of claim 3, wherein said pair of platforms each include a pair of adjustable inner legs to create a stepping box position.

5. The hockey training system of claim 4, wherein said legs are attachable to said base by a plurality of pins extending through said base and a lower end of said legs.

6. The hockey training system of claim 1, wherein said base includes raised outer perimeter defining a floor, a plurality of angled slots within an interior portion of said raised outer perimeter, and a pair of end members removably positionable within said angled slots for defining a sliding area upon said floor for a user performing a sliding exercise.

7. The hockey training system of claim 1, wherein said at least one reserve unit includes a curved portion connected to said side opening for assisting in guiding hockey pucks from said at least one reserve unit.

8. The hockey training system of claim 7, wherein said at least one reserve unit is comprised of a pair of reserve units positionable upon opposing ends of said base.

9. The hockey training system of claim 1, wherein said at least one cover member is comprised of a pair of cover members.

10. A hockey training system, comprising:

a base useable by a user as a slide board in a sliding position;

a pair of platforms positionable upon said base in either a plyometrics position or a stepping box position;

at least one cover member positionable upon an upper portion of said base for a user to stand upon and a shooting member for allowing a user to practice shooting hockey pucks upon while standing upon said at least one cover member; and a net positionable at an end of said shooting member for arresting hockey pucks.

11. The hockey training system of claim 10, wherein said base includes a raised outer perimeter defining a floor comprised of a slippery plastic material.

12. The hockey training system of claim 10, wherein said pair of platforms each include a pair of adjustable outer legs thereby angling said pair of platforms inwardly in a plyometrics position; and wherein said pair of platforms each include a pair of adjustable inner legs to create a stepping box position.

13. The hockey training system of claim 10, wherein said legs are attachable to said base by a plurality of pins extending through said base and a lower end of said legs.

14. The hockey training system of claim 10, wherein said base includes raised outer perimeter defining a floor, a plurality of angled slots within an interior portion of said raised outer perimeter, and a pair of end members removably positionable within said angled slots for defining a sliding area upon said floor for a user performing a sliding exercise.

* * * * *